US005222774A

United States Patent [19]

Fukumoto et al.

[11] Patent Number: 5,222,774

[45] Date of Patent: Jun. 29, 1993

[54] LID LOCK APPARATUS

[75] Inventors: Ryoichi Fukumoto, Nagoya; Kazuhide Itagaki, Toyota; Kazuhiro Sumiya, Hekinan; Yasuaki Suzuki, Kariya; Kouji Ooe, Nagoya, all of Japan

[73] Assignee: Aisin Seiki Kabushiki Kaisha, Kariya, Japan

[21] Appl. No.: 858,589

[22] Filed: Mar. 27, 1992

[30] Foreign Application Priority Data

Mar. 29, 1991 [JP] Japan ..... 3-66633

[51] Int. Cl.[5] ..... E05C 1/12

[52] U.S. Cl. ..... 292/144; 292/DIG. 22; 296/97.22

[58] Field of Search ..... 292/144, 201, DIG. 22, 292/341.16; 74/625, 89.15; 296/97.22

[56] References Cited

U.S. PATENT DOCUMENTS

| | | | |
|---|---|---|---|
| 3,947,060 | 3/1976 | Zimmer et al. | 292/144 X |
| 4,833,465 | 5/1989 | Abend et al. | 292/144 X |
| 4,949,563 | 8/1990 | Gerard et al. | 292/144 X |
| 5,002,322 | 3/1991 | Fukumoto | 292/341.16 |
| 5,044,678 | 9/1991 | Detweiler | 292/144 |

*Primary Examiner*—Richard E. Moore

*Attorney, Agent, or Firm*—Finnegan, Henderson, Farabow, Garrett and Dunner

[57] ABSTRACT

A lid lock apparatus is comprised of an opening formed in a vehicle-body, a lid pivotally mounted to the vehicle-body, a locking mechanism is connected to the plate and has a shaft which engages and disengages the lid when operated to its closed and opened condition, respectively. A driving mechanism which is arranged for releasing the engagement between the shaft and the lid when in the closed condition, is mounted on the locking mechanism and positioned in such a manner that the driving mechanism is set to be in close relationship to the plate while being perpendicular to the axis of the shaft.

4 Claims, 7 Drawing Sheets

LID LOCK APPARATUS

BACKGROUND OF THE INVENTION

The present invention relates to a lid lock apparatus, and in particular to a lid lock apparatus for keeping in a closed position, a lid used for opening/closing an opening of a vehicle body which is regarded as an inlet port of a fuel tank within the vehicle body.

In a conventional lid lock apparatus, which is disclosed in Japanese Utility Model Laid-open Print No. Sho58(1983)-111762, a locking mechanism for keeping the closed position of a lid used for opening/closing an opening of a vehicle body, is arranged co-axially with a driving mechanism, for releasing the closed condition of the locking mechanism.

However, in the foregoing structure, the driving mechanism is required to be located apart from a portion to which the locking mechanism is secured, resulting in the weight of the driving mechanism being a relatively large moment, on the locking mechanism. This requires the reinforcement of each locking mechanism per se; and the portion to which the locking mechanism is secured, which is contrary to the light weight of the vehicle body.

SUMMARY OF THE INVENTION

It is an object of the invention to provide a improved lid lock apparatus which obviates the above conventional drawbacks.

It is another object of the invention to provide an improved lid lock apparatus which is lighter in weight than the conventional lid lock apparatus.

In order to attain the foregoing objects, a lid lock apparatus is comprised of an opening formed in a vehicle-body, a lid pivotally mounted to the vehicle-body for opening/closing the opening and is movable between an opened condition and a closed condition, a plate formed in the vehicle body, a locking mechanism connected to the plate and having a shaft which is engaged with and disengaged from the lid upon its closed and opened condition, respectively, and a driving mechanism arranged for releasing the engagement between the shaft and the lid in the closed condition, mounted on the locking mechanism and positioned in such a manner that the driving mechanism is set to be in the closed relationship to the plate when perpendicular to the axis of the shaft.

BRIEF DESCRIPTION OF THE DRAWINGS

The above and other objects, features and advantages of the present invention will be more apparent and more readily appreciated from the following detailed description of preferred exemplarily embodiments of the present invention, taken in connection with the accompanying drawings, in which.

Figure 5:
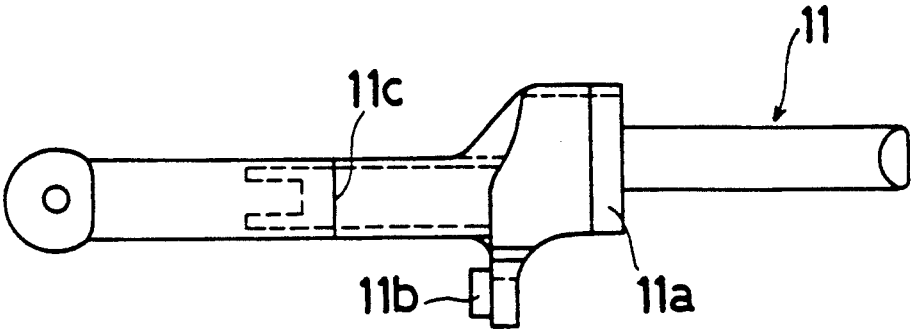
Figure 6:
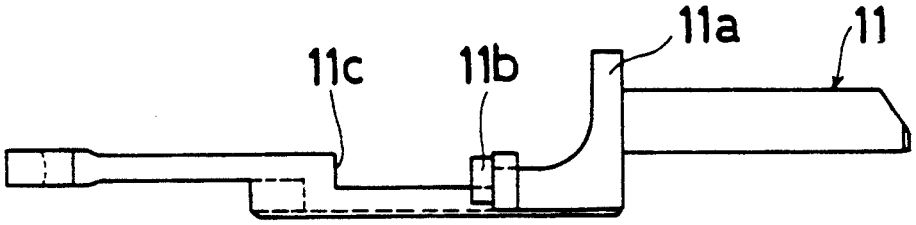
Figure 7:
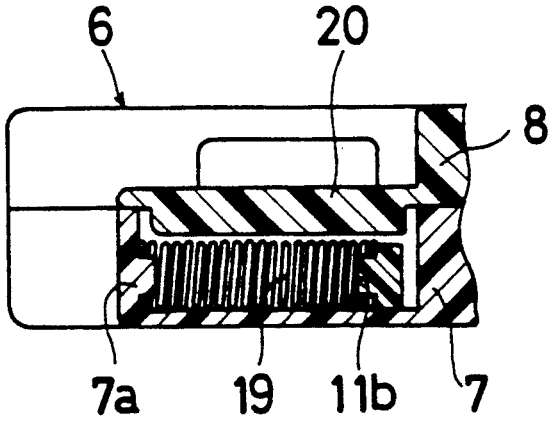
Figure 8:
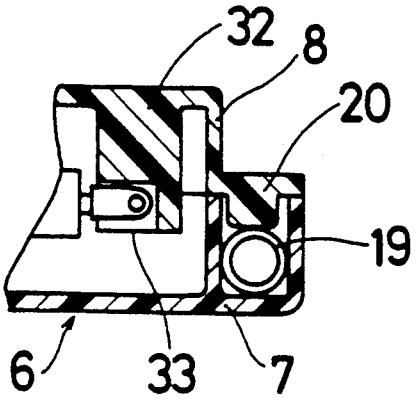
Figure 9:
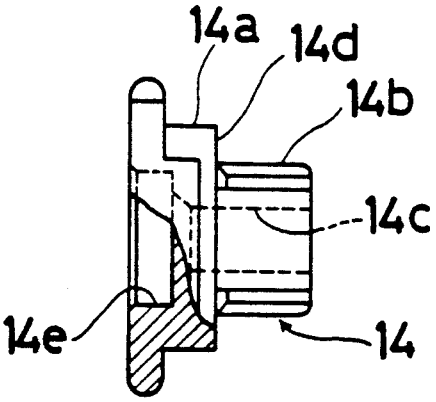
Figure 10:
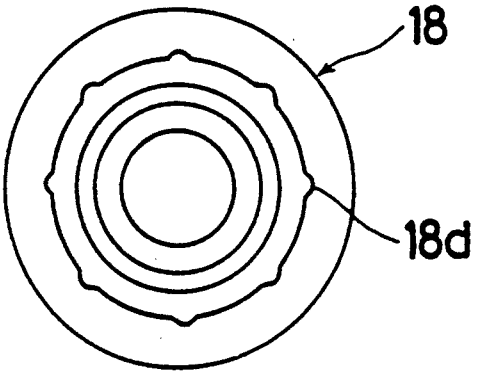
Figure 11:
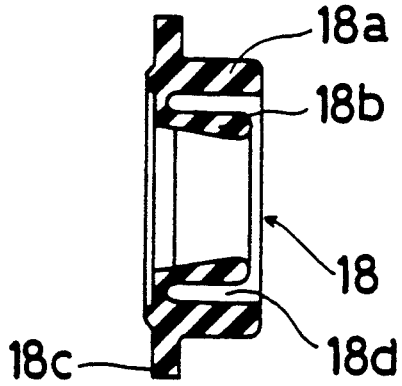
Figure 12:
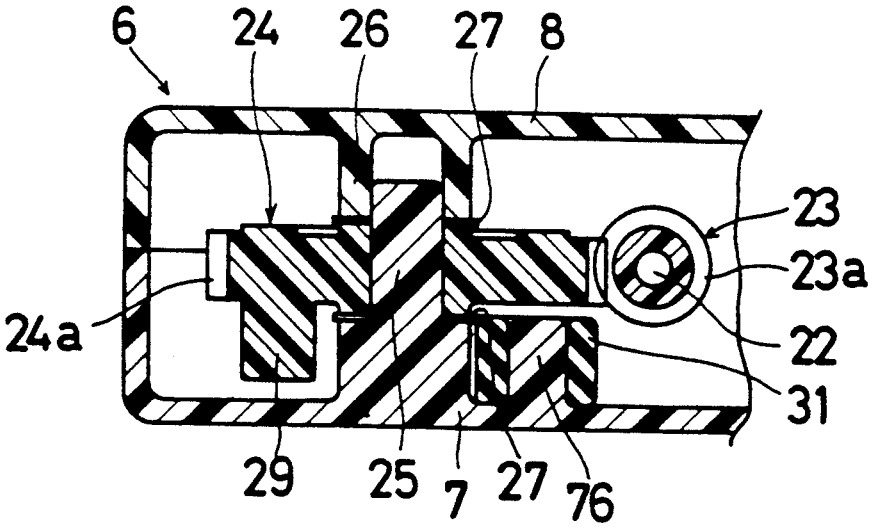
Figure 13:
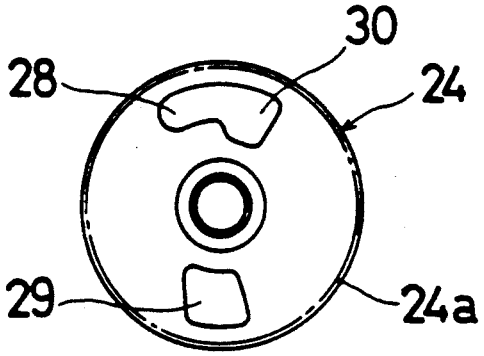
Figure 14:
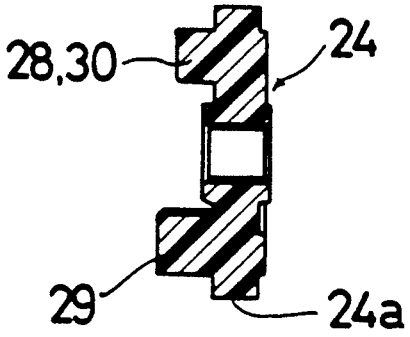

FIG . 4 is a vertical cross-sectional view of a lid lock apparatus per se according to the present invention;

FIG. 5 is a plane view of a shaft;

FIG. 6 is a front view of a shaft;

FIG. 7 is a horizontal cross-sectional view showing the location and position of a spring;

FIG. 8 is a vertical cross-sectional view showing the spring location and positioning;

FIG. 9 is a partial cross-sectional view of a guide member;

FIG. 10 is a plane view of stopper;

FIG. 11 is the vertical cross sectional view of a stopper shown in FIG. 10;

FIG. 12 is a cross-sectional view for showing a worm-wheel support assembly;

FIG. 13 is a plane view of the worm wheel;

FIG. 14 is a vertical cross-sectional view of the worm wheel; and

Figure 15:
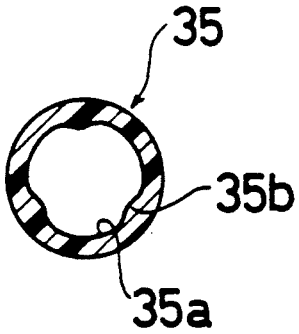

FIG. 15 is a horizontal cross sectional view of a cap.

DESCRIPTION OF THE PREFERRED EMBODIMENT

Figure 1:
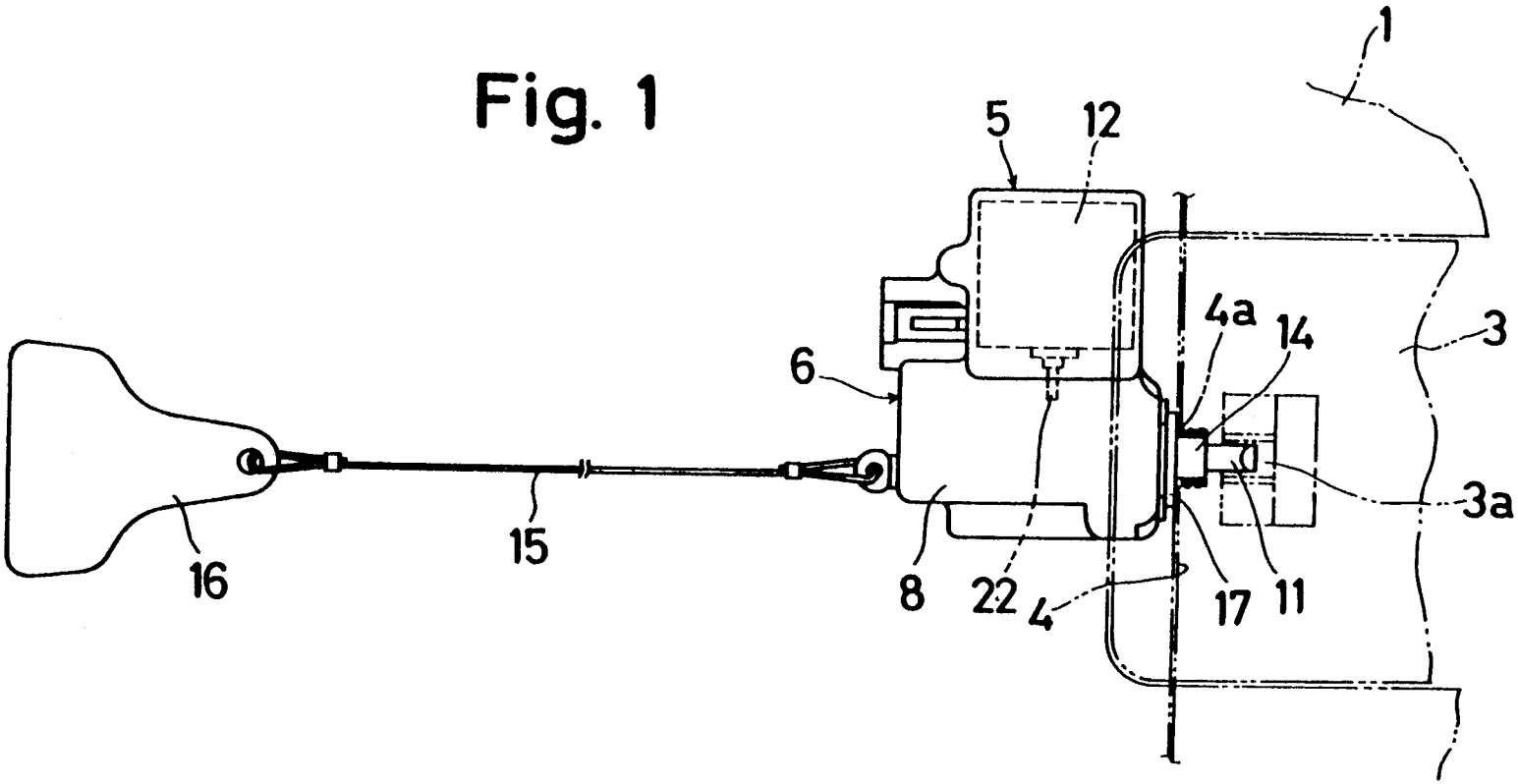
FIG. 1 is an top view showing the mounted condition of a lid lock apparatus according to the present invention.
Figure 2:
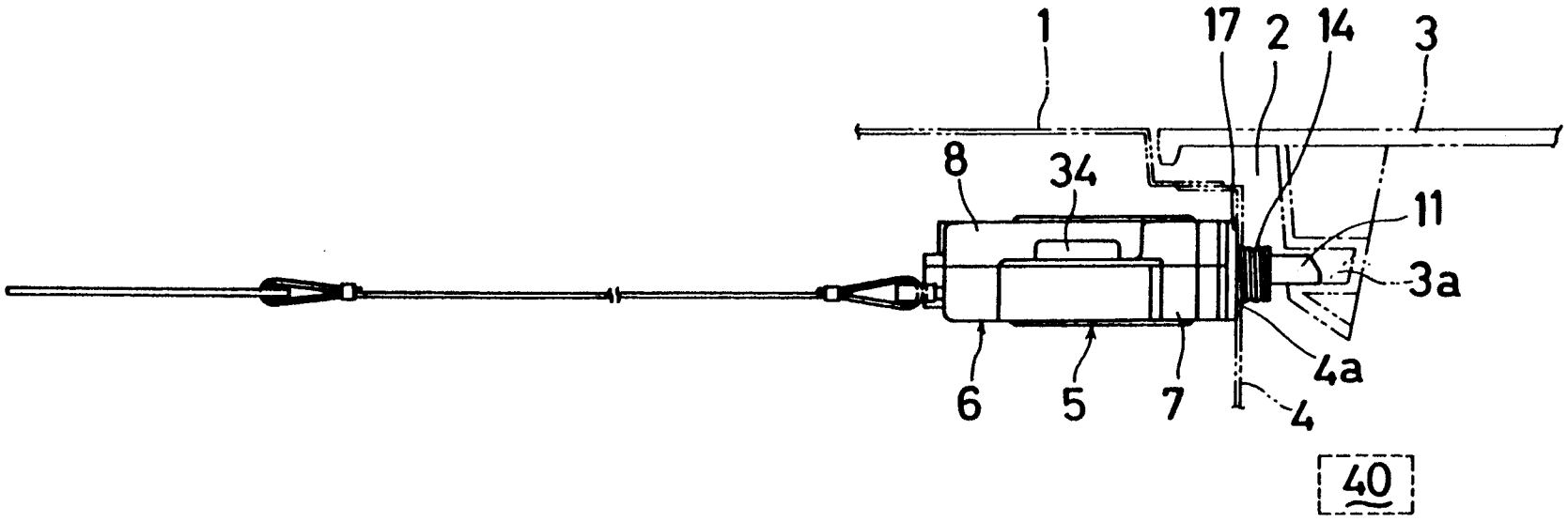
FIG. 2 is a side view showing the mounted condition of a lid lock apparatus according to the present invention.

Referring to FIGS. 1 and 2, a vehicle body 1 is formed with an opening 2 which is used as an inlet port of a fuel tank 40. A lid 3 for opening/closing the opening 2 is pivotally mounted to the vehicle body 1 in such a manner that an outer surface of the vehicle body 1 is in a common plane with an outer surface of the lid 3 when in a closed position. Within the vehicle body 1, a panel 4 which is made of a synthetic resin is secured to the vehicle body 1 and a locking mechanism 5, which maintains the closed position of the lid 3 secured to the panel 4.

As seen from FIGS. 1 through 4, the locking mechanism 5 includes a casing 6 which has a housing 7 made of a synthetic resin and a cover 8 made of a synthetic resin. The cover 8 is combined to the housing 7 by a suitable means such as ultrasonic welding, in such a manner that this combination is established in the thickness direction of the housing 7 which corresponds to the vertical direction in FIG. 2. Between the housing 7 and the cover 8, an inner space 10 is defined, in which a shaft 11, a motor 12 and a gear mechanism 13 are accommodated.

The shaft 11 is extended movably or slidablly into the casing 6 via a guide 14. A distal end of the shaft 11 is so projected in the outward direction from the casing 6 as to be in engagement with a concave or recess portion **3*a* of the lid 3. Also, a root end of the shaft 11 is operatively connected via a wire 15 to a handle 16 which is positioned in an inner space of the vehicle body 1** or trunk (not shown) thereof.

As shown in FIGS. 5 and 6, the shaft 11 is in the form of an integration of a stopper portion **11*a* which is engageble with a stopper 18, a retaining portion 11*b* for retaining a spring 19, and a wall 11*c* which is in association with a spring 19. As seen from FIGS. 3, 7 and 8, the spring 19 is positioned between the retaining portion 11*b* and a retaining portion 7*a* of the housing 7 so as to be offset from the wall 11*c*. The spring 19 is set to bias or urge continually the shaft 11 in its extension direction which corresponds to the right direction in FIG. 3. Thus, this arrangement enables the reduction of the length of the shaft 11 in its axial direction corresponding to the horizontal direction in FIG. 1, resulting in the weight reduction of the locking mechanism 5, the reduction of the moment applied to each of the casing 6 and the panel 4**, and permitting the formation thereof from synthetic resin.

The cover is formed with a projection 20 for preventing movement of the spring 19 and shaft 11 in the thickness direction of the casing 6. A guide 21 is positioned so as to oppose to the wall 11*c* for providing axial movement of the shaft 11 while restricting the vertical movement of the shaft 11 which corresponds to the vertical movement thereof in FIG. 3.

The guide 14 which is made of a metal, as shown in FIG. 9, is in the form of an integration of a support portion 14*a* which is supported by the casing 6 by being held between the housing 7 and the cover 8; a threaded portion 14*b* for securing the locking mechanism 5 to the panel 4 in such a manner that the threaded portion 14*b* is driven or screwed into a nut (not shown), which snugly fits in an opening 4*a* of the panel 4, a guide hole 14*c* for guiding the shaft 11, a holding surface 14*c* for holding a sealing member 17, and a holding portion 14*e* for holding the stopper 18.

The sealing member 17 is disposed around the thread portion 14*b* between the guide member 14 and the panel 4 in order to prevent the invasion of fluid such as gasoline and/or water, dust or other foreign substances through the hole 4*a*. The stopper 18 made of an elastic material such as a rubber is, as best shown in FIGS. 10 and 11, in the form of an integration of a portion 18*a* to be held by the holding portion 14*e* of the guide 14, lip portion 18*b*, and a stopper portion 18*c*. The lip portion 18*b* is set to be in fluid tight engagement with an outer surface of the shaft 11 so as to prevent the invasion of fluid such as gasoline and/or water, dust or other foreign substances into the casing 6. The stopper portion 18*c* is engageble with the stopper portion 11*a* of the shaft 11 so as to prevent an excess projection or outward extension thereof in the outward direction. A plurality of equally pitched ribs 18*d* are formed integrally with on an outer periphery of the portion 18*a* and a radius of each rib 18*d* is slightly larger than that of an inner portion of the holding portion 14*e* of the guide 14 in order to establish a snug fit of the portion 18*a* of the stopper into the holding portion 14*e* of the guide 14. Thus, an easy removal of the stopper 18 from the guide 14 is prevented, which assures fluid-tightness between the shaft 11 and the guide 14. A plurality of gaps 14*e* are defined between the lip portion 18*b* and the holding portion 18*a* of the stopper 18, each of which can be used as a reservoir of grease. Thus, the sliding friction of the shaft 11 permits reduction of the output force of the the motor 12, resulting in minituarization and weight reduction of the motor 12 and decrease of the friction wear of the lip portion 18*b*.

Figure 3:
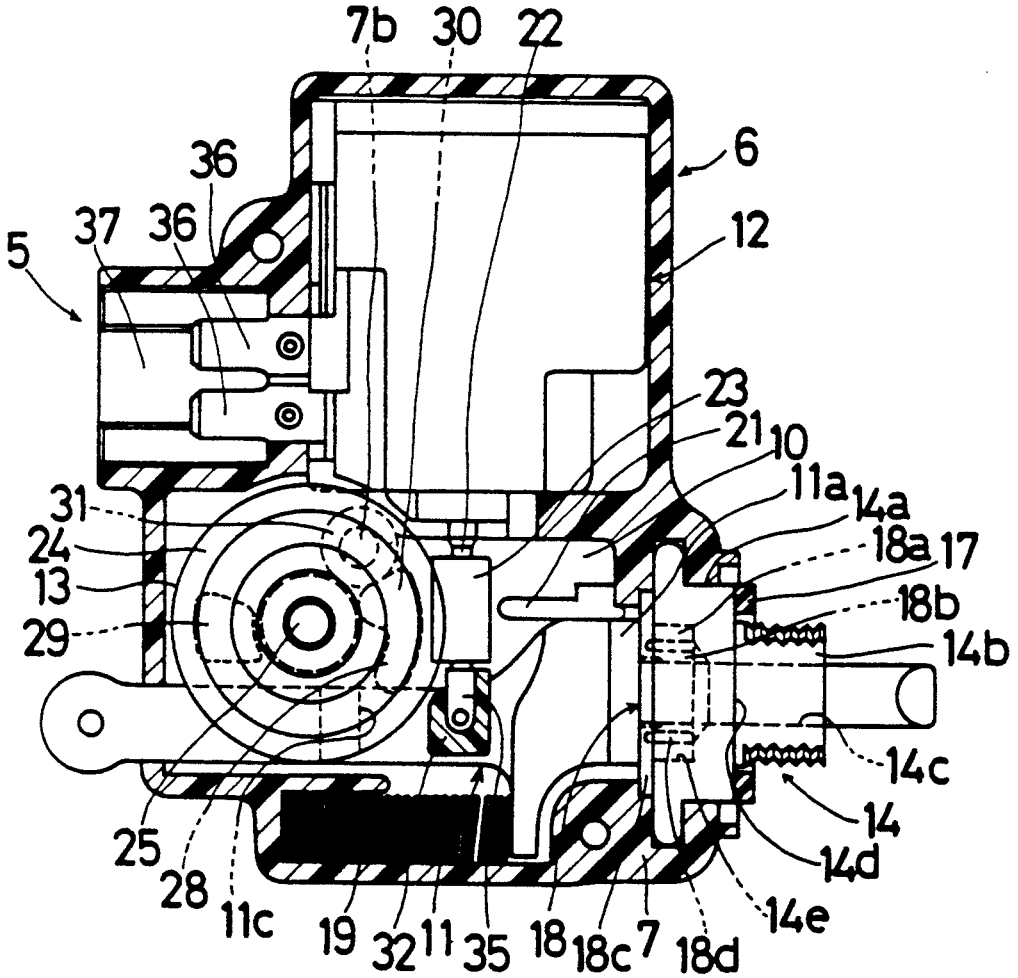
FIG. 3 is a horizontal cross-sectional view of a lid lock apparatus per se according to the present invention.
Figure 4:
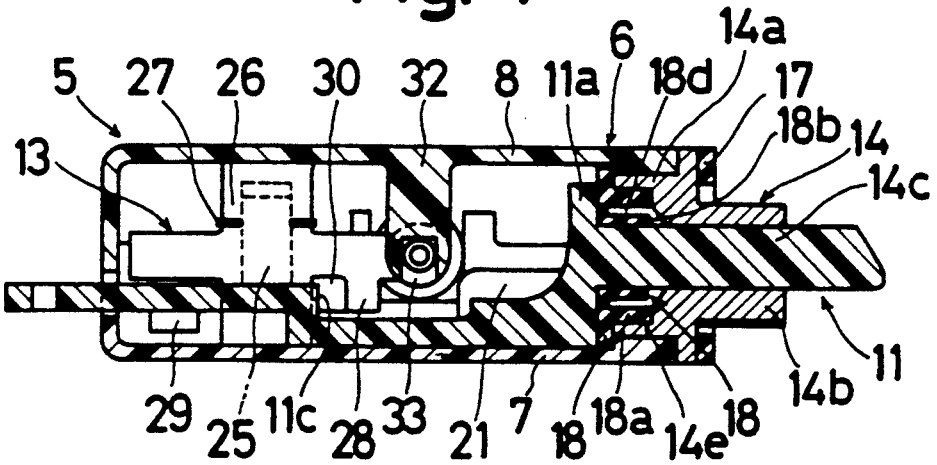

As shown in FIG. 3, the gear mechanism 13 includes a worm gear 23 which is fixedly mounted on a rotatable shaft 22 of the motor 12 and a worm wheel 24 which is rotatably supported by the casing 6 to be in mesh engagement with the worm gear 23.

As shown in FIG. 12, the worm wheel 24 is rotatbly mounted on a shaft 25 which is formed integrally with the housing 7 and a distal end of the shaft 25 fit in a concave or recess portion 26 which is formed in the cover 8. Thus, during operation of the apparatus, the load in the radial direction which is to be applied to the shaft 25 from the worm wheel 24 is received by both of the housing 7 and the cover 8, permitting integration of the shaft 25 and the housing with a synthetic resin.

A washer 27 is provided between the worm wheel 24 and the housing 7 (the cover 8) in order to assure the smooth rotation of the worm wheel 24. Each of teeth 23*a* of the worm gear 23 and each of teeth 24*a* of the worm wheel 24 are set to be large in the advancing direction, and each tracing direction is in inclination to the cover 8. This enables the mutual transmission of torque from the worm gear 23 to the worm wheel 24 and vice versa, and the load applied to the worm gear 23 in the radial direction is converted in a direction toward the cover 8.

Referring to FIGS. 3, 4, 13 and 14, the worm wheel 24 is provided with a cam portion 28 and a pair of projections 29 and 30. The cam portion 28 is set to be engageble with the wall 11*c* of the shaft 11 upon rotation of the worm wheel 24 in one direction. The housing 7 has a holding portion 7*b* to which a stopper 31 made of an elastic material such as a rubber is secured. The projections 29 and 30 are engageble with the stopper 31. Upon engagement of the stopper 31 with the projection 29 (30), further rotation of the worm wheel 24 in one (the other ) direction is prevented. It is to be noted that the cam portion 28 and the projection are formed integrally with each other. The sole stopper 31 regulates opposite rotations of the worm wheel 24, which requires no additional stopper. The space which would be occupied by the additional stopper, can be used for the increased thickness of each projection 29/30, which leads to the reinforcement thereof and the wheel gear 24 per se which is required to be of sufficient strength. Thus, the wheel gear 24 can be made of a synthetic resin.

As shown in FIGS. 3 and 8, the motor 12 is held between the housing 7 and the cover 8. The motor 12 has the rotatable shaft 22 which is rotated with the worm gear 23. A distal end of the shaft 22 is rotatably supported by supporter 32 which is formed integrally with the housing 7. This structure is so designed to prevent the deformation of the shaft 22 due to the reaction force transmitted to the worm gear 23 from the worm wheel 24 upon rotation thereof. Thus, a normal or an expected mesh engagement between the worm gear 23 and the worm wheel 24 can be maintained. The reaction force to the worm gear 23 is set to be oriented toward the cover 8 due to the tracing direction of the worm gear 23, and the supporter 32 is in the opened configuration 33 toward the housing 7. Thus, the shaft 22 of the motor 12 can overlap the shaft 11 in its thickness direction, and the flexible arrangement of the motor 12 having the shaft 22 with the worm gear 23 is available. This results in permitting the motor 12 a to be positioned above the shaft 11 along the vertical line as shown in FIG. 1, and also the motor 12 is parallel with the panel 4 at a near portion thereof. The moment applied to the casing 6 and the panel 4 due to the weight of the motor 12 can be decreased, resulting in no additional reinforcement being required for the casing 6 and the panel 4 which can be made of synthetic resin. In light of the above, the weight reduction of the locking mechanism 5 and a corresponding weight reduction of the vehicle-body 1 can be effected. In addition, the position of the motor 12 above the shaft 11 can the malfunction of the motor 12 due to the unexpected invasion of gasoline, water or other foreign substance in the event of breakage of the sealing function of the lip portion 18*b* of the stopper 18.

It is to be noted that a hole 34 is provided at a lower portion of the casing 6 which is in fluid communication with the inner space 10 and the exterior of the casing 6. The invaded gasoline, water or other foreign substance can be drained through the hole 34.

A cap 35 made of an elastic material is fixedly mounted on the shaft 22 of the motor 12 which is to be located between the shaft 22 and the supporter 32. As best shown in FIG. 15, an inward projection 35*b* is formed on a connecting portion 35*a* of the cap 35 so as to prevent the removal thereof from the shaft 22. This cap 35 serves to prevent the vertical movement of the motor 12 due to the vehicle vibration, so as not to cause unpleasant noise and/or abnormal wear at a brush portion (not shown) of the motor 12. In addition, in the case of the torque transmission from the worm wheel 24 to the worm gear 23, the rotation torque, which is transmitted toward the distal end of the shaft 11 after generation thereat can be restricted, which decreases the operational resistance of the shaft 11 caused by the rotation torque. Thus, the biasing force of the spring 19 can be set at a lower value, and the output force of the motor 12 can be set at a lower value, permitting the minituarization of motor 12 and the spring 19.

As shown in FIG. 3, terminals 36 of the motor 12 are accommodated in a connector 37 positioned between the housing 7 and the cover 8.

Hereinafter, operation of the foregoing lid lock apparatus will be described under the condition shown in FIGS. 1 through 3 wherein the lid 3 is in its closed position and the opening 2 is closed. When the motor 12 is turned on, the shaft 22, the worm gear 23 and the worm wheel 24 are rotated in one direction. Due to the resultant rotation, the cam portion 28 is brought into engagement with the wall 11*c*, resulting in the retraction of the shaft 11 in its inward or leftward direction in FIG. 3 with the assistance of rotational force from the worm wheel 24 against the biasing force of the spring 19. Thus, the shaft 11 disengages the recess portion 3*a* of the lid 3 and is released, which releases the closed condition of the lid 3. Further rotation of the worm wheel 24 in one direction is prevented by the engagement of the projection 29 with the stopper 31; and the detection of the resultant engagement turns the motor 12 off. As soon as the motor 12 stops, shaft 11 is returned to its original position by moving in its extension extended direction or the rightward direction as shown in FIG. 3. At this time, the worm wheel 24 is returned to its original position by being rotated in the other direction. This rotation is restricted by the enagagement of the projection 30 with the stopper 31.

Obviously, many modifications and variations of the present invention are possible in light of the above teachings. It is, therefore, to be understood that within the scope of the appended claims, the invention may be practiced otherwise than as specifically described.

What is claimed is:

1. A lid lock apparatus for a vehicle body having an opening therein, comprising:

a lid pivotally mounted to the vehicle body for opening and closing the opening, said lid being operable to be moved between an open and a closed condition;

a plate mounted to the vehicle body and accessibly positioned adjacent the opening;

a locking mechanism having a casing secured to the plate, and a first shaft projecting axially from the casing positioned to engage and disengage the lid when in a closed and opened condition respectively, the casing having a first dimension extending in a first direction along the axis of the first shaft perpendicular to the plate, the casing having a second dimension extending parallel to the plate and perpendicular to the first dimension in a common plane, the casing having a third dimension extending in a third direction perpendicular to the common plane and the first and second directions;

a spring disposed in the casing spaced from the first shaft in the second direction toward the lid continuously urging the first shaft in an axial direction parallel to the first direction;

a motor mounted in the casing spaced from the first shaft in the second direction, a rotatable second shaft driven by the motor and extending axially in a direction toward the spring parallel to the second direction; and a gear mechanism spaced from the first shaft in the second direction, said mechanism including a worm gear mounted on and rotatable with the rotatable second shaft, a third shaft secured to the casing and extending axially in a direction parallel to the third direction, a worm wheel rotatably mounted on the third shaft in mesh engagement with the worm gear, said gear mechanism being responsive to the rotation of the second shaft for rotating the worm wheel via the worm gear, said worm wheel being positioned and configured to engage the first shaft upon rotation of the worm wheel for moving the first shaft from engagement with the lid.

2. The lid lock apparatus of claim 1 further comprising a guide member positioned between the casing and the first shaft for guiding the first shaft in an axial direction.

3. The lid lock apparatus of claim 1 wherein the casing includes a support portion in engagement with and retaining a distal end portion of the second shaft.

4. The lid lock apparatus of claim 2 further comprising a sealing member disposed within the casing surrounding the first shaft adjacent the guide member.

* * * * *